US006672797B1

(12) United States Patent
Zachman et al.

(10) Patent No.: US 6,672,797 B1
(45) Date of Patent: Jan. 6, 2004

(54) LINEAR TRANSDUCER ARRANGEMENT

(75) Inventors: Mark Eugene Zachman, Troy, OH (US); Jerald Wayne Yost, Casstown, OH (US)

(73) Assignee: Trimble Navigation Limited, Sunnyvale, CA (US)

( * ) Notice: Subject to any disclaimer, the term of this patent is extended or adjusted under 35 U.S.C. 154(b) by 0 days.

(21) Appl. No.: 09/491,907

(22) Filed: Jan. 27, 2000

Related U.S. Application Data

(60) Provisional application No. 60/117,348, filed on Jan. 27, 1999.

(51) Int. Cl.[7] ..... E01C 23/07; E01C 19/22

(52) U.S. Cl. ..... 404/84.5; 404/120

(58) Field of Search ..... 404/72, 84.05, 404/84.1, 84.5, 118, 120; 701/50

(56) References Cited

U.S. PATENT DOCUMENTS

| | | | | | |
|---|---|---|---|---|---|
| 3,674,094 | A | * | 7/1972 | Kuntz | 172/4.5 |
| 3,953,145 | A | * | 4/1976 | Teach | 404/84 |
| 4,807,131 | A | * | 2/1989 | Clegg | 701/50 |
| 4,924,374 | A | | 5/1990 | Middleton et al. | |
| 4,925,340 | A | * | 5/1990 | Heiser et al. | 404/75 |
| 4,930,935 | A | * | 6/1990 | Quenzi et al. | 404/75 |
| 5,156,487 | A | * | 10/1992 | Haid | 404/72 |
| 5,288,167 | A | * | 2/1994 | Gaffard et al. | 404/84.05 |
| 5,401,115 | A | * | 3/1995 | Musil et al. | 404/72 |
| 5,556,226 | A | * | 9/1996 | Hohmann, Jr. | 404/84.1 |
| 5,987,371 | A | * | 11/1999 | Bailey et al. | 701/50 |
| 6,082,927 | A | * | 7/2000 | Dahlinger et al. | 404/72 |
| 6,129,481 | A | * | 10/2000 | Tapio et al. | 404/102 |
| 6,227,761 | B1 | * | 5/2001 | Kieranen et al. | 404/84.5 |
| 6,530,720 | B1 | * | 3/2003 | Green | 404/84.1 |

FOREIGN PATENT DOCUMENTS

| | | | | |
|---|---|---|---|---|
| SE | WO 94/01812 | * | 1/1994 | G05D/1/10 |

* cited by examiner

*Primary Examiner*—Thomas B. Will
*Assistant Examiner*—Raymond W. Addie
(74) *Attorney, Agent, or Firm*—Dinsmore & Shohl LLP

(57) ABSTRACT

A transducer arrangement and method that generates control signals indicating relative positions of the ends of a hydraulically movable tool of a machine. The generated control signals of the present invention are used by a conventional control circuit of the machine to control the ends of the hydraulically movable tool having elevation receivers as an desired mode of operation or when reception by one of the elevational receivers of a elevational reference, which provides an absolute position of the ends of the tool, is interrupted. The conventional control circuit of the machine uses the generated signal of the transducer arrangement of the present invention to maintain a relative elevation position of one side of the tool to the absolute position of the other side of the tool as desired or until both receiver can reacquire the elevational reference.

6 Claims, 4 Drawing Sheets

LINEAR TRANSDUCER ARRANGEMENT

CROSS-REFERENCE TO RELATED APPLICATIONS

This application claims the benefit of U.S. Provisional Application No. 60/117,348, filed Jan. 27, 1999, which is incorporated herein by reference.

BACKGROUND OF THE INVENTION

The present invention relates to a linear transducer arrangement for control of a tool carried by a machine, and more specifically, to a control system of a hydraulically moveable tool carried by a machine having laser receivers receiving actual elevational positions of the ends of the tool from an external laser transmitter and a pair of linear transducer arrangement providing relative elevational positions of the ends of the tool to each other.

In concrete paving operations, after concrete is poured it is commonly finished by drawing a tool, such as a screed head, over the surface of the contour to finish the surface of the concrete before it cures. In asphalt paving operations, after asphalt is laid it is commonly leveled to a desired depth by drawing a tool, such as also a screed head of a paver, over the surface of the contour. Finally, in grading operations, a surface is graded to a desired depth by drawing a tool, such as a blade of a grader, over the surface of the contour. Thus, although the physical configurations of the types of screed heads and the grader's blade are not identical, the functions of these tools are analogous.

Typically, a hydraulic cylinder connected to each end of the tool of the machine, raise and lower the ends of the tool independently. It has been common to determine the elevational positions of the ends of the tool by using a laser transmitter or a sonic pulse as a reference in order to achieve the chosen surface level. As such, the raising and lowering of the tool is controlled by the control system and is in response to reception of the reference signal.

In the laser transmitter arrangement, a projected rotating beam of laser light defines a reference plane. A pair of laser receivers, one receiver mounted at each end of the tool on an associated mast for vertical movement with the tool, detect the reference plane and a control system of the machine then actuates hydraulic valves to supply fluid to the hydraulic cylinders in response to this detected level. As a result, the elevation of each end of the tool can be precisely controlled. In the sonic pulse arrangement, as disclosed by U.S. Pat. No. 4,924,374 to Middleton, et al., a tool carried by a machine, can level a surface to a chosen depth by determining the time it takes for an acoustic pulse to travel from a transducer, such as an ultrasonic receiver, provided on a mast at each end of the tool to a reference surface and back. As a result, with this time value being used to calibrate a microprocessor-controlled distance-measuring device the elevation of each end of the tool can be precisely controlled. Accordingly, in both types of the above described arrangements, each of their respective type of receivers, either laser or sonic, provides elevational feedback to drive the hydraulics controlling the elevation of each side of the tool.

A problem may arise, however, if one the receivers is blocked by something of an appreciable height, such as, for example, a support column in a building, in the case of the laser receiver or interrupted in the case of the ultrasonic receiver. When a blockage or disruption occurs, there is a need to maintain the relative elevation of the ends of the tool until either the laser beam or sonic pulse can be reacquired by both receivers mounted at the ends of the tool. There is also a need to be able to pull the tool along a straight path, while maintaining the chosen thickness of the layer and matching forms or existing surfaces during a screeding, paving, or grading application.

One approach to this problem, in the laser arrangement is to set up two external laser transmitters at the same elevation on opposite sides of the tool. In this way, if a column blocks one of the transmitters, the other external transmitter is likely to be illuminating the receivers at the ends of the tool, thereby compensating for the blockage. Essentially, the prior art method is to eliminate all blind spots around the receivers. However, this prior art method adds an additional cost of a second external transmitter and time to properly set up the second external laser transmitter to eliminate the possibility of a column block.

Another approach to this problem is to use a gravity-based cross slope sensor, which detects the angular shifts of the tool as the tool tilts up and down. Additionally, the gravity-based cross slope sensor may be used as a reference for set up and control in a super flat, or plumb, floor application. Accordingly, when both sides of the tool are within the appropriate dead band, the desired grade of the cross slope sensor is measured and stored in memory of the tool's control system. When one laser receiver loses reception of the elevational reference, the cross slope sensor detects the height of the interrupted receiver side of the tool relative to its uninterrupted receiver side. That is, the cross slope sensor provides a relative measurement of the interrupted laser receiver which, when coupled with the absolute measurement of the uninterrupted laser receiver, provides an estimate of the absolute position of the interrupted laser receive. The control system of the tool can be used the provided absolute and estimated absolute positions to control the elevation of ends of the tool. However, several disadvantages exist in the cross slope sensor arrangement described above.

First, the gravity-based cross slope sensor is vulnerable to accelerations along its sensitive axis, resulting in miscalculations of the tool's slope. In screeding operations, it is quite common for the operator to "side shift" the tool around columns as he pulls the tool back. Since the sensitive axis of the gravity-based cross slope sensor is parallel to the length of the tool, this side shifting can cause noticeable acceleration along the sensitive axis of measurement, thus dramatically affecting the feedback of the cross slope sensor. Second, harmonics of the machine boom carrying the tool, which do not cause significant enough elevation shifts to be seen in the laser receivers at both ends of the tool, are detectable by gravity-base cross slope sensor since measuring acceleration and not machine movement. Third, in order to reduce the effects of noise and to compensate for some of the low frequency harmonics of the machine vibration, considerable low pass filtering of the cross slope sensor is required. The use of low pass filters on the output of the gravity-based cross slope sensor adds an inherent time lag to the system, which degrades the bandwidth performance of the blocked side. Finally, separate control gains for the cross slope sensor are used to compensate for the time lag, as well as, the change in loop gain, thus requiring frequent calibration adjustments in order to maintain performance of the control system.

Therefore, there is a need for providing a control system of a hydraulically moveable tool carried by a machine that does not require setting up a second external laser transmitter in order to maintain the elevation of the ends of the tool in a blocked or interrupted receiver situation.

There is also a need for providing a control system of a hydraulically moveable tool carried by a machine that does not require a gravity-based cross slope sensors to maintain the relative elevation of the ends of the tool in a blocked or interrupted situation until the reference signal(s) can be reacquired by both receivers.

SUMMARY OF THE INVENTION

These needs are met by a linear transducer arrangement according to the present invention that provides a control signal for use by a conventional control circuit or system of a machine to maintain a selected elevational position between ends of a hydraulically moveable tool carried by the machine and a reference, when reception of the reference by one of a pair of elevation receivers at the ends of the tool is blocked or interrupted until the reference can be reacquired by both elevation receivers. Normally, absolute measurements are available on both side ends of the tool via a pair of mounted elevation receivers, such as laser or ultrasonic receivers. When reception of a reference, such as a laser beam from a laser transmitter or a sonic pulse from a transponder, by one of the of elevation receivers is interrupted, the control signal generated by the linear transducer arrangement of the present invention is used by the machine's control system to maintain the relative elevation of the side ends of the tool to each other until the reference can be reacquired by both elevation receivers. The present invention assist the control system in controlling the tool in a blocked or interrupted condition since that at any given time, at least one absolute measurement is available for an unblocked or uninterrupted side end of the tool and one relative elevational measurement from that unblocked or uninterrupted side end to the blocked or interrupted side of the tool is available to the control system of the machine. Accordingly, with the generated control signals from the transducer arrangement of the present invention the control system can maintain a relative elevation position of the interrupted receiver side to the absolute position of the uninterrupted receiver side until both receiver can reacquire the elevational reference.

In one aspect, the present invention is a linear transducer arrangement for generating control signals for use by a conventional control circuit or system of a machine, having elevation receivers, in controlling movement of individual hydraulically moveable ends of a tool carried by a machine so as to maintain a selected elevational position between each end of the tool and a reference when reception one of the elevation receivers of the reference is interrupted, the laser transmitter comprising a first linear transducer mounted on a first end of the tool; and a second linear transducer mounted on a second end of the tool, the first and second linear transducers provide electrical outputs indicating the extension of elevation cylinders of the hydraulically moveable ends of the tool, thus providing to the control circuit the relative height of the interrupted elevation receiver to the uninterrupted elevation receiver until the disruption clears.

In another aspect, the present invention is a method of controlling the elevational position of hydraulically moveable ends of a tool of a machine in relationship to a reference detected by elevation receivers attached the ends of the tool, when reception of one of the elevation receivers of the reference is interrupted, comprising the steps of selecting a desired elevational position of the tool to the reference with the elevation receivers; generating outputs with a pair of linear transducers, each of the pair of linear transducers is associated with an elevation cylinder at each of the hydraulically moveable ends of the tool, and each of the outputs indicating the extension of the associated elevation cylinder; and using the output of the linear transducer associated with the hydraulically moveable end having the interrupted elevation receiver to maintain a constant relative height between the hydraulically moveable ends until the disruption clears.

Other objects, features and advantages will appear more fully in the course of the following discussion.

DETAILED DESCRIPTION OF THE INVENTION.

Figure 1:
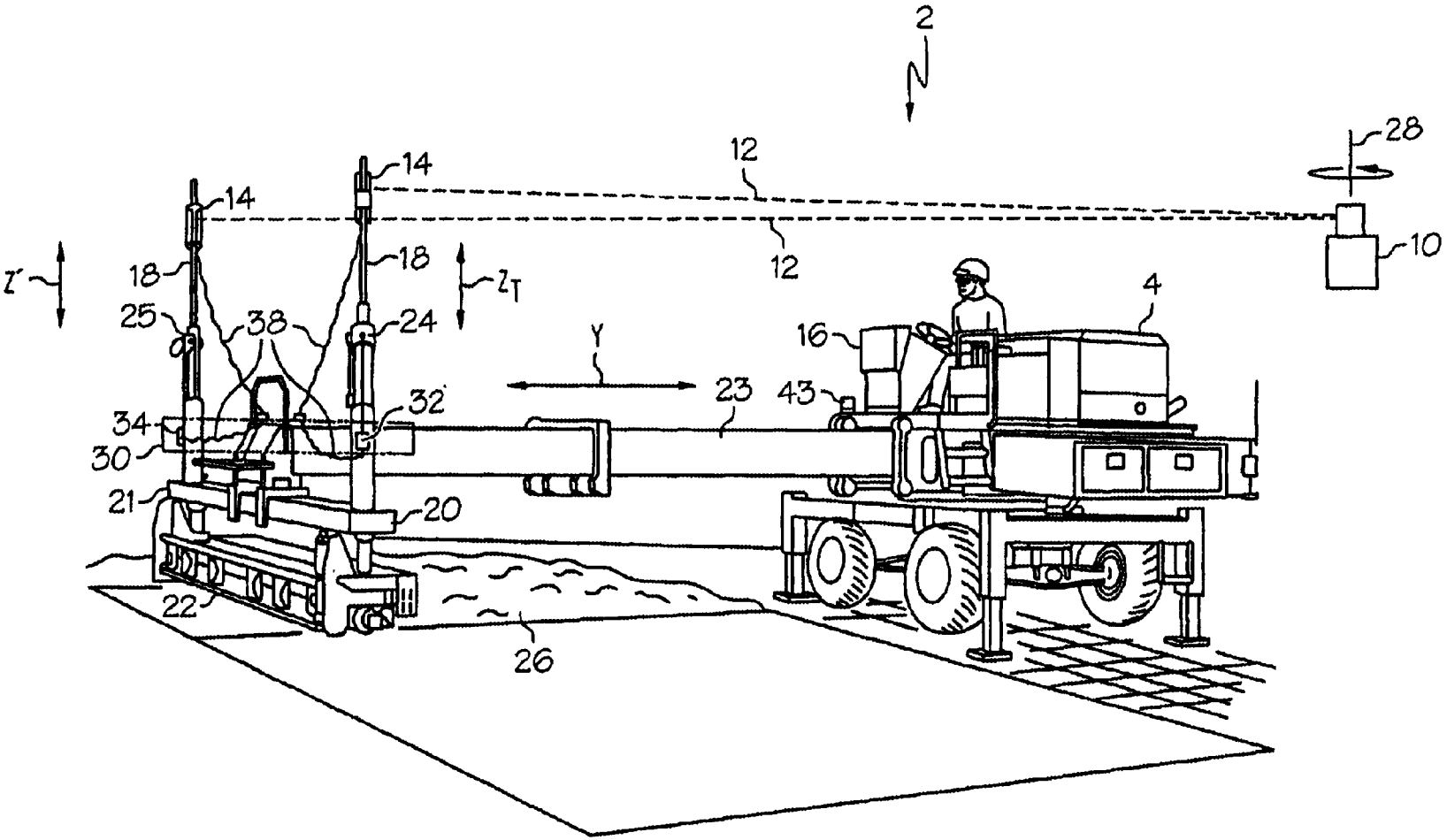
FIG. 1 illustrates a screeding operation of a typical concrete screed utilizing the control arrangement of the present invention.

Referring to FIG. 1 of the drawings, the device implementing the preferred embodiment of invention herein is a conventional control system 2 for a machine, such as a concrete screed 4, that typically consist of an external laser transmitter 10, transmitting a rotating laser beam 12, in order to provide a reference, a pair of elevation receiver, such as laser receivers 14, and a control box 16 for controlling electro-hydraulic control values (not shown) of the concrete screed 4. The concrete screed 4 further includes a pair of masts 18, each carrying one of the pair of laser receivers 14, attached with and moved generally vertically, independently, with respective ends 20 and 21 oaf tool or screed head 22. The screed head 22 is attached to the end of a hydraulic boom arm 23 which moves the screed head 22 in longitudinal direction Y. During normal operation, the control box 16 causes actuation of the hydraulic valves such that hydraulic cylinders 24 and 25 at the ends 20 and 21, respectively, independently raise or lower, indicated by vertical directions $Z_T$ and $Z_T'$, the ends 20 and 21 of the screed head 22, as needed, as it is drawn in the direction of x over the surface of uncured concrete 26. It is to be appreciated that the raising and lowering of the screed head 22 in the vertical directions Z and Z' is accomplished in response to reception of the reference laser beam 12 by the pair of laser receivers 14. The laser beam 12 rotates about an axis, as indicated at 28, so as to define the reference as a reference plane of laser light.

As discussed above, a difficulty arises with the conventional control system 2 of this type when the path of the laser beam 12 to one of the pair of elevation receivers 14 is temporarily blocked by a column or other obstruction at a work site. In the present invention, an additional linear transducer arrangement, indicated generally by 30, is mounted on each side of the tool or screed head 22 on the respective masts 18 to over come the above mention difficulty with the conventional control system 2 of the screed.

The linear transducer arrangement 30, indicated by the dashed box, includes a pair of linear transducers 32 and 34. Each of the pair of linear transducers 32 and 34 provides an electrical output indicating the extension of the associated hydraulic cylinder 24 and 25 upon which it is mounted. It is to be appreciated that any variety of linear transducers 32 and 34, such as string encoders, sonic transducers, laser transducers, linear variable differential transformer (LVD1), and the like, will work in the linear transducer arrangement 30 of the present invention for measuring the extension of hydraulic cylinder 24 and 25.

The transducer arrangement 30, in a similar manner as the pair of elevation receivers 14, is electrical coupled to the control system 16 via electrical lines 38, which also provides power thereto. Thus, after an initial calibration, the transducer arrangement 30, via the electrical lines 40, provides to the control system 16 output signals, which indicates the relative height between the pair of masts 18. It is to be appreciated that the control system 16 accepts the output signals from the transducer arrangement 30 as a standard input. Accordingly, the control system 16 uses the output signals of the transducer arrangement 30 to determine and therefore control the relative height of the two ends 20 and 21 of the screed head 22 when one of the normally absolute measurements provided by the pair of elevation receivers 14 is unavailable due to a column block situation or a disruption that produces a temporarily erroneous signal. When one of the pair of elevation receivers or laser receivers 14 loses the laser beam 12, the associated linear transducer 32 or 34 for the hydraulic cylinder 24 or 25 is used as the control input for that side of the tool or screed head 22. Since the elevation of the laser receiver 14 at the opposite end of the tool or screed head 22 is known, and the relative extension of the two hydraulic cylinders 24 and 25 is known from the outputs of the linear transducers 32 and 34, the elevation of the tool or screed head 22 at the end at which the laser receiver 14 is blocked can be determined. Thus, the control system 2 using the output of the linear transducer 32 or 34 associated with the end 20 or 21 having the interrupted elevation receiver 14 to maintain a constant relative height between the ends 20 and 21 until the disruption clears.

The transducer arrangement of the invention may also be used in combination with an alternative conventional control system that employs for elevational receivers ultrasonic distance measuring devices or followers, such as commercially available "Tracers" from Spectra Precision, Inc., Dayton, Ohio, to work a surface to a predetermined elevation. Commonly assigned U. S. Pat. No. 4,924,374 to Middleton, et al. teach such a control system employing followers, which is incorporated by reference herein.

Figure 2:
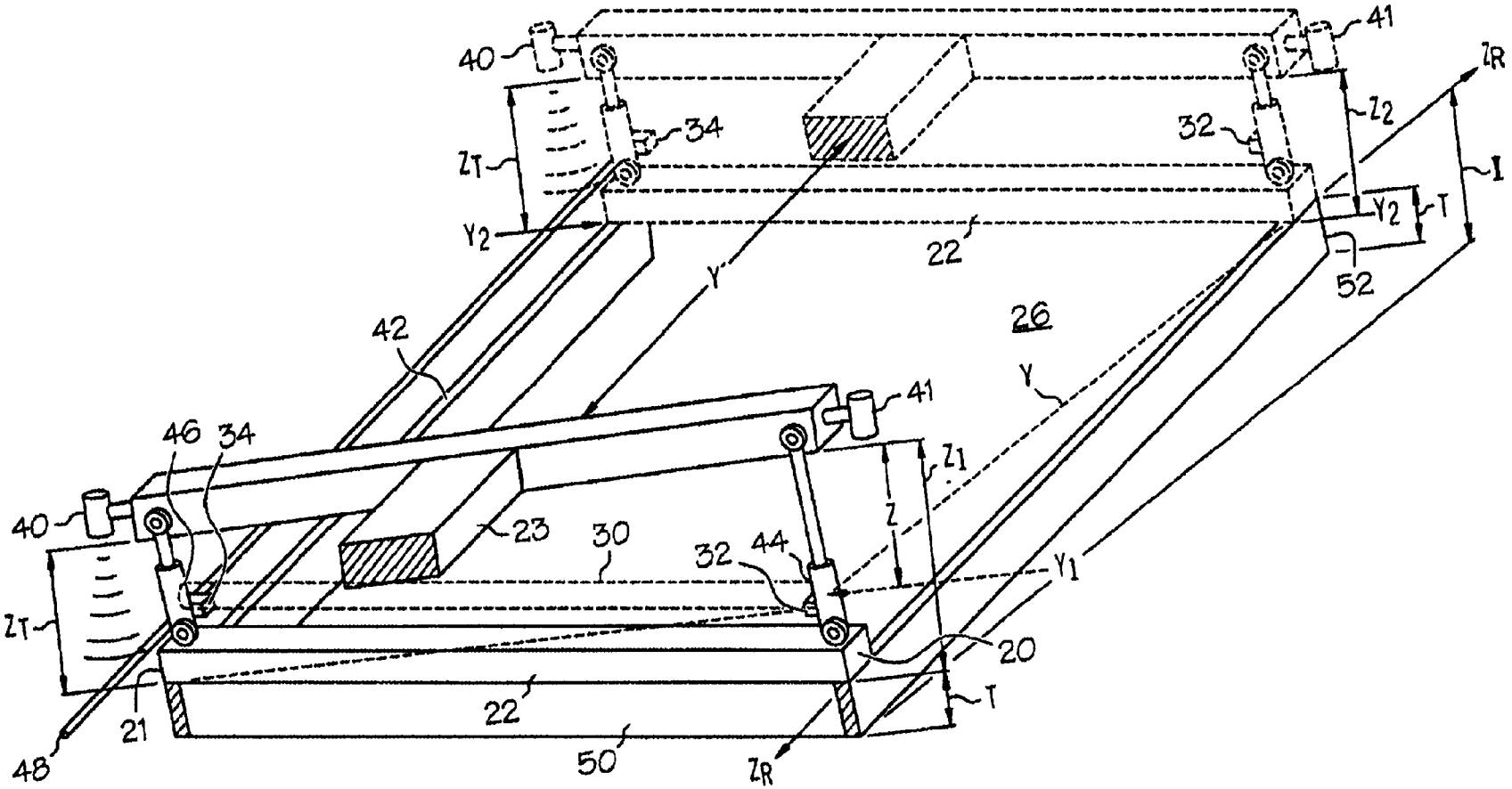
FIG. 2 illustrates operation of an alternative control arrangement of the present invention.

FIG. 2 of the drawings illustrates the use of the present invention, in combination with a pair of followers 40 and 41, to screed concrete that has been poured into a form 42 where the surface of the finished concrete 26 is to have a predetermined inclination I. FIG. 2 also depicts the longitudinal movement of the screed head 22 in the direction Y. An additional linear transducer 43, see FIG. 1, is provided to monitor both distant and speed of the screed head's 22 longitudinal movement, via extension/retraction of boom 23, where the present longitudinal position of the screed head 22 in the Y direction is indicated by Y'. In this alternative embodiment of the control system for the concrete screed 4, elevation cylinders or hydraulic cylinders 44 and 46 that raise and lower the screed head 22 are also depicted diagrammatically in FIG. 2. Accordingly, with the depicted alternative control system the linear transducers 32 and 34 of the present invention can be employed in a concrete paving application by the control system to finish the concrete surface 26, as discussed hereafter.

In the concrete paving application a desired elevational position of the tool or screed head 22 to a reference 48, such as a surface or surveyor's string, can be maintained by the alternative control system using the output signal of the linear transducer 32 on end 20 of the tool or screen head 22 and a follower 40 on end 21. The control system maintains the pull at a proper elevation for a desired concrete pad thickness T by initially benching the screed head 22 all the way in or at first position $Y_1$. A reading for $Z_1$ and $Y_1$ are taken, which represent the required elevation and distance for end 20 at a proximal end 50 of the form 42 at the completion of a pull. Next the boom arm 23 is extended out to a surface or form and benched in an extended position or second position $Y_2$. A reading for $Z_2$ and $Y_2$ is then taken at this point, representing the required elevation and distance for end 20 at a distal end 52 of the form 42 at the start of the pull. Additionally, at the second position $Y_2$ the follower 40 is benched to the reference 48 by measuring the sonic pulse distant $Z_T$. A relationship between these points is represented by the following equation:

$$Z_R=((Z_1-Z_2)/Y)(Y') \quad (1)$$

where $Z_R$ a solved for relative reference line, $Y=Y_2-Y_1$, which is the total length of a screed head pull, and Y'=the current position of the screed head during the pull.

Accordingly, the control system using equation (1) can calculate the adjustment necessary for the side without the elevation receiver relative to the absolute position of the side with the receiver. Accordingly, during a pull of the screed head over the form 42 from $Y_2$ to $Y_1$, the relative reference line $Z_R$ is maintained by using the output signal of the linear transducer 32 and the reference signal generated by the available follower 40 tracking the reference 48 with sonic pulses in order to match the form 42.

Figure 3:
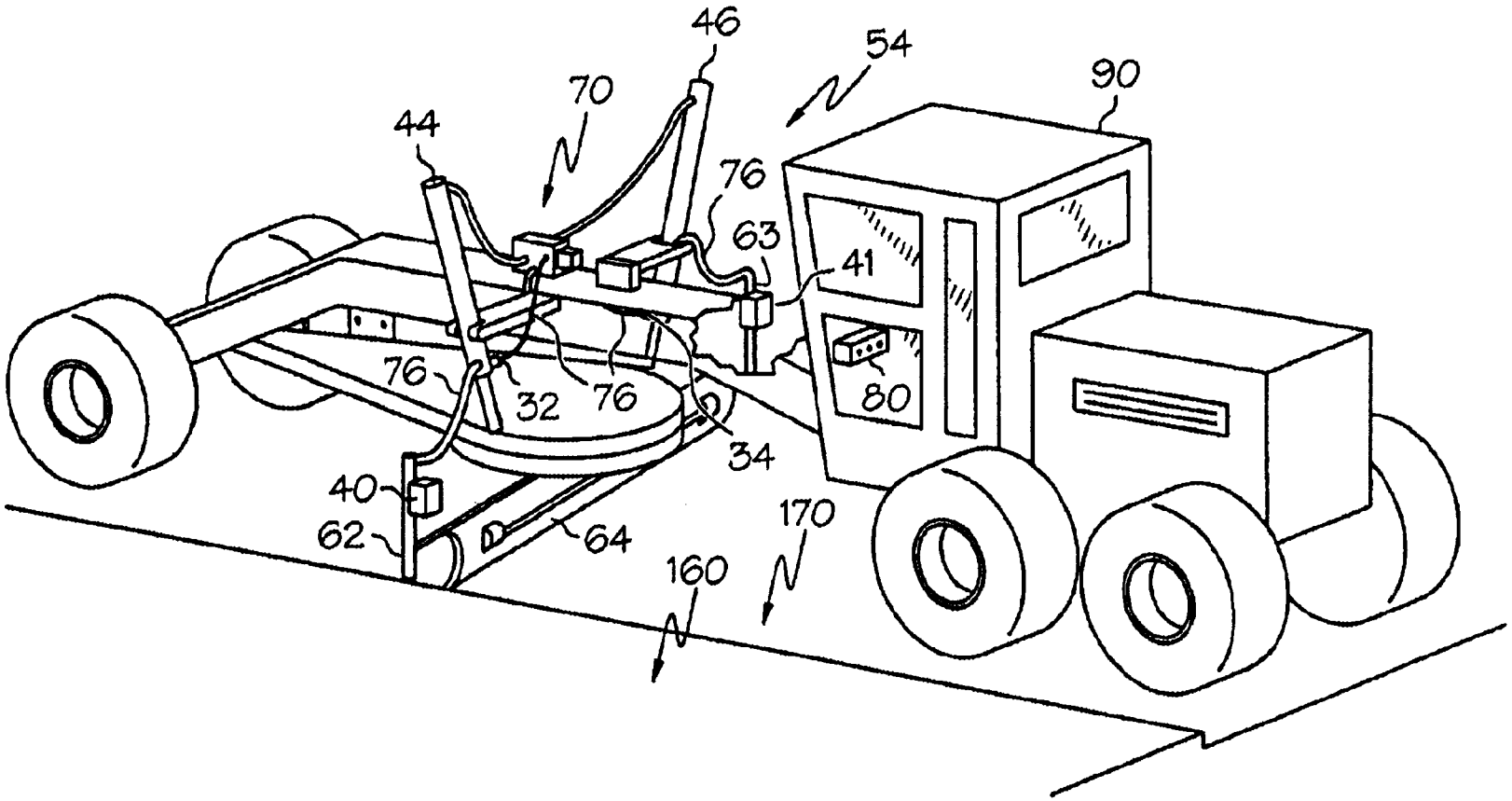
FIG. 3 illustrates a grading operation of a typical grader utilizing the alternative control arrangement of the present invention.
Figure 4:
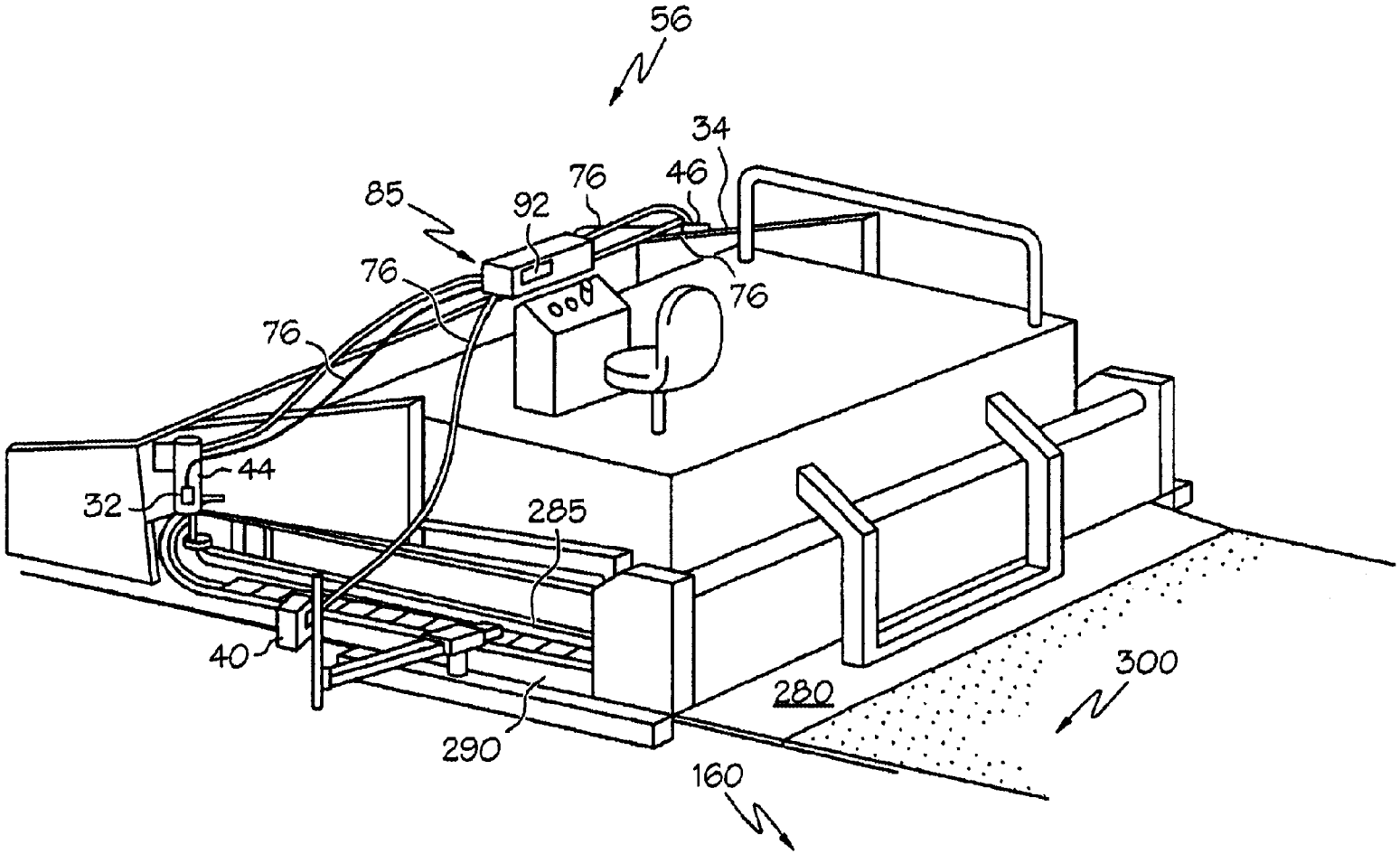
FIG. 4 illustrates a paving operation of a typical paver utilizing the alternative control arrangement of the present invention.

It is to be appreciated that the transducer arrangement of the present invention could also be used in combination with conventional control systems of other types of machines. As depicted in FIGS. 3 and 4, the conventional control systems of a grader 54 and a paver 56, operate essentially in the same manner as on the alternative control system of the concrete screed 4, with certain differences to be described below. References made to the concrete screed 4, in the alternative embodiment of FIG. 2, may be taken as references also to the grader 52 and paver 56, with the differences in the paver embodiment being discussed below, after a complete discussion relating to the embodiments utilizing the grader 54.

Referring to FIG. 3 of the drawings, the control system implementing the invention herein includes the pair of followers 40 and 41, which are mounted on frames 62 and 63 carried by the earth grader 54. The frames 62 and 63 are mounted on a mold board or blade 64, which is itself carried by the grader 54. The frames 62 and 63 and the blade 64 are vertically adjustable by means of hydraulic rams or elevation cylinders 44 and 46. In an alternative embodiment, the blade may be mounted on the frame, and the frame in turn carried by the grader. As mentioned above, each elevation cylinder 44 and 46 governs the height of one side of the blade 64, and the elevation cylinders 44 and 46 are in turn governed by a hydraulic valve system 70. The valve system 70 is controlled by the pair of followers 40 and 41, in the manner taught by commonly assigned U.S. Pat. No. 4,924,374 to Middleton, et al, thus no further discussion is provided. With each elevation cylinder 44 and 46 attached, in a similar fashion as depicted in FIG. 2, is the linear transducer 32 and 34, respectively, in accordance with the present invention. Each transducer 32 and 34 in the same manner as each one of the pair of followers 40 and 41 is connected, via electrical lines 76, to a control system 80. The control system 80 is mounted in a cab 90 of the grader 54 for viewing and operation by an operator of the grader. The structure and operation of the invention will hereinafter be described relative to one of the followers 40 and frame 62 maintaining a first reference surface 160, but apply equally to the other follower 41 and frame 63 maintaining a second reference surface 170.

It is to be appreciated that each of the followers 40 and 41 emits acoustic chirps, i.e. a series of acoustic pulses, which travels to either the first reference surface 160 and the second reference surface 170, respectively, and are reflected back to their respective followers 40 and 41. The control system 80 counts the total time of travel for a single chirp from each follower 40 and 41 to echo back by stopping a counter for each follower 40 and 41, which was started when the chirp was emitted. The microprocessor (not shown) of the control system 80 uses the time values to control the side levels of the blade 64 and to "lock-on" to the desired depth. Thereafter, as the operator drives the grader 54, the followers 40 and 41 continue to emit acoustic chirps, thus detecting any changes in the level of the first reference surface 160. If, for instance, the level of the first reference surface 170 rises, the follower 40 detects the returned sonic pulse in a shorter time period, and this shorten time period indicated to the control system 80 that it needs to raise the blade 64 on that side, such that a constant distance is maintained between follower 40 and the reference surface 160, thus ensuring that the blade 64 remains at a constant depth or offset relative to the surface 160. Accordingly, should one of the followers 40 and 41 become interrupted causing a temporarily erroneous signal the control system 80 of the earth grader 54 can use the output signal from the linear transducer 32 or 34 on the interrupted side to maintain a desired depth of that side of the blade 64 relative to the reference ground surface 160 or 170 in a similar fashion as described previously above with regards to control system embodiments of the concrete screed 4.

The transducer arrangement of the invention may also be used on a paver 56, as depicted in FIG. 4, wherein the follower 40 and paver control box 85 are mounted on the paver 180 in essentially the same manner as on the concrete screed 4 and grader 54, with certain differences to be described below. The paver 56 includes a paver blade or screed 280, which pushes before it, as the operator of the paver drives along, a quantity of paving material 290, which may be sand, asphalt or the like. The paving material 290 is leveled by the blade 280 into the desired surface configuration. The basic operation of the paver 56 is analogous to that of the grader 30, in that the blade 280 is raised and lowered to compensate for the level of the reference surface 160. The arrangement of the blade 280 of the paver 56 is, of course, somewhat different than that of the blade 40 of the grader 30. Thus, the blade 280 is connected at the forward end of the paver 56 to the hydraulic rams or elevation cylinders 44 and 46 via draw bars 285, one of which appears in FIG. 4 and the other of which would be located symmetrically opposite the draw bar 285 on the other side of the paver. With each elevation cylinder 44 and 46, attached in a similar fashion as depicted in FIG. 2, is the linear transducer 32 and 34, one of which appears in FIG. 4 and the other also of which would be located symmetrically opposite the shown transducer 32 on the other side of the paver. Each transducer 32 and 34 in the same manner as each one of the pair of followers 40 and 41 is connected, via electrical lines 76, to the control system 85.

As the forward ends of the draw bars 285 are raised, the change in the height of the leading edge of the blade 280, which would be beneath the paver 56, causes the blade level to travel upwards, due in part to a change in the angle of attack of the blade 280 relative to the paving material 290. Conversely, as the draw bars are lowered, the leading edge of the blade 280 lowers, and digs into the paving material 290 somewhat, resulting in a lower pavement surface 300 relative to the first reference surface 160. Thus, although the physical configurations of the screed head 22, the grader blade 40 and the paver blade 280 are not identical, the functions of these blades are analogous. Accordingly, should one of the followers 40 and 41 become interrupted causing a temporarily erroneous signal, the control system 85 of the paver 56 can use the output signal from the linear transducer 32 or 34 on the interrupted side to maintain a desired depth of that side of the blade 280 relative to the reference ground surface 160 or lower pavement surface 300 in a similar fashion as described previously above with regards to control system embodiments of the concrete screed 4.

The linear transducer arrangement 30 of the present invention provides a number of advantages over conventional control systems in which the slope across the tool is measured with a gravity based slope sensor to compensate of the loss of reception of the reference by one of the pair of elevation receivers. Unlike those types of control systems that incorporates a gravity-based sensor, the linear transducer arrangement of the present invention is unaffected by accelerations experienced by the tool (screed head 22, grader blade 64, or paver blade 280). In normal screeding, paving, or grating operations, the tool 22, 64, 280 of the machine 4, 54, 56, receptively, often rotates or shifts laterally. This movement applies an acceleration along the sensitive centerline axis of a slope sensor that is oriented to measure the angle of the tool's cross slope. Accordingly, the linear transducer arrangement of the present invention are completely immune to such acceleration. Additionally, since the linear transducers measure true movement and not just acceleration, they are not as vulnerable to possible machine vibration as would be the case with gravity-based cross slope sensors. Essentially, the linear transducer arrangement is no more sensitive to machine vibration than the pair of elevation receivers 14 or 40 and 41. As a consequence, extensive low pass filtering of the output signal from each of the linear transducers 32 and 34 at low frequencies is not needed. Hence, the linear transducers 32 and 34 induce no appreciable time lag in it output signal into any of the conventional control systems 16, 80 or 85 and thus is not limited to being sampled at 10 Hz, as is the case with the pair of conventional laser receivers 14. Furthermore, for example, a user display 92 of the control system 85, easily communicates with the linear transducers 32 and 34 for modes of operation where adjusting the elevation of the side with the blocked or interrupted follower 40 or 41 is desired (i.e. an indicate mode).

What is claimed is:

1. An arrangement for generating control signals for use by a conventional control system of a machine in controlling movement of individual hydraulically moveable ends of a tool carried by the machine so as to maintain a selected elevational position between each end of the tool and a reference when reception of one of the elevation receivers of the reference is interrupted, comprising:

a pair of elevation receivers mounted for movement with opposite ends of said tool carried by said machine to provide signals to the control system indicating the elevational position between each end of said tool and said reference, a first linear transducer mounted on a first end of the tool; and a second linear transducer mounted on a second end of the tool, the first and second linear transducers providing electrical outputs indicating the extension of elevation cylinders of the hydraulically moveable ends of the tool, thus providing to the control system the relative height of the interrupted elevation receiver to the uninterrupted elevation receiver until the disruption clears.

2. An arrangement for generating control signals for use by a conventional control system as provided in claim 1, wherein said machine is selected from the group consisting of a concrete screed, a paver, and a grader.

3. An arrangement for generating control signals for use by a conventional control system as provided in claim 1, wherein said reference is a rotating laser beam of a laser transmitter and said pair of elevation receivers are laser receivers.

4. An arrangement for generating control signals for use by a conventional control system as provided in claim 1, wherein said reference is an sonic pulse from a transponder and said pair of elevational receivers are ultrasonic receivers.

5. An arrangement for generating control signals for use by a conventional control system as provided in claim 1, wherein said first and second linear transducers are selected from a group consisting of string encoders, sonic transducers, laser transducers, and linear variable differential transformer.

6. A method of controlling the elevational position of hydraulically moveable ends of a tool of a machine in relationship to a reference detected by elevation receivers attached to the ends of the tool, when reception of one of the elevation receivers of the reference is interrupted, comprising the steps of:

(a) selecting a desired elevational position of the tool to the reference with the elevation receivers;

(b) generating outputs with a pair of linear transducers, each of said pair of linear transducers associated with an elevation cylinder at one of the hydraulically moveable ends of the tool, and each of said outputs indicating the extension of said associated elevation cylinder; and (c) using said output of said linear transducer associated with the hydraulically moveable end having the interrupted elevation receiver to maintain a constant relative height between the hydraulically moveable ends until the disruption clears.

* * * * *

UNITED STATES PATENT AND TRADEMARK OFFICE

CERTIFICATE OF CORRECTION

PATENT NO. : 6,672,797 B1
DATED : January 6, 2004
INVENTOR(S) : Zachman et al.

It is certified that error appears in the above-identified patent and that said Letters Patent is hereby corrected as shown below:

Column 4,
Line 36, “21 oaf tool” should read -- 21 of a tool --; and

Column 5,
Line 1, “linear variable differential transformer (LVDI)” should read -- linear variable differential transformer (LVDT) --.

Signed and Sealed this

Twenty-seventh Day of July, 2004

JON W. DUDAS
*Acting Director of the United States Patent and Trademark Office*